US007946344B2

(12) United States Patent
Braithwaite et al.

(10) Patent No.: US 7,946,344 B2
(45) Date of Patent: May 24, 2011

(54) METHOD AND ASSEMBLY FOR PRODUCING OIL AND/OR GAS THROUGH A WELL TRAVERSING STACKED OIL AND/OR GAS BEARING EARTH LAYERS

(75) Inventors: Stephen Richard Braithwaite, Rijswijk (NL); Johannes Cornelis Maria Van Dongen, Rijswijk (NL)

(73) Assignee: Shell Oil Company, Houston, TX (US)

( * ) Notice: Subject to any disclaimer, the term of this patent is extended or adjusted under 35 U.S.C. 154(b) by 9 days.

(21) Appl. No.: 12/443,066

(22) PCT Filed: Sep. 26, 2007

(86) PCT No.: PCT/EP2007/060195

§ 371 (c)(1),
(2), (4) Date: Mar. 26, 2009

(87) PCT Pub. No.: WO2008/037730

PCT Pub. Date: Apr. 3, 2008

(65) Prior Publication Data

US 2009/0266549 A1 Oct. 29, 2009

(30) Foreign Application Priority Data

Sep. 29, 2006 (EP) ..... 06121527

(51) Int. Cl.
*E21B 29/00* (2006.01)
*E21B 43/11* (2006.01)
*E03B 3/18* (2006.01)

(52) U.S. Cl. ..... 166/297; 166/227

(58) Field of Classification Search ..... 166/387, 166/179, 227, 297, 55, 191
See application file for complete search history.

(56) References Cited

U.S. PATENT DOCUMENTS

| | | | | |
|---|---|---|---|---|
| 2,530,966 | A * | 11/1950 | Huber | 175/4.56 |
| 4,428,431 | A | 1/1984 | Landry et al. | 166/298 |
| 6,404,139 | B1 | 6/2002 | Sasaki et al. | 315/169.3 |
| 6,581,682 | B1 * | 6/2003 | Parent et al. | 166/180 |
| 7,753,121 | B2 * | 7/2010 | Whitsitt et al. | 166/297 |
| 2002/0157829 | A1 | 10/2002 | Davis et al. | 166/297 |
| 2003/0230406 | A1 | 12/2003 | Lund | 166/278 |
| 2006/0075889 | A1 | 4/2006 | Walzer | 89/1.15 |
| 2006/0196660 | A1 | 9/2006 | Patel | 166/250.15 |

FOREIGN PATENT DOCUMENTS

| | | |
|---|---|---|
| GB | 2374886 | 10/2002 |
| WO | WO0127436 | 4/2001 |
| WO | WO0220941 | 3/2002 |
| WO | WO02090712 | 11/2002 |
| WO | WO2005005094 | 1/2005 |

* cited by examiner

*Primary Examiner* — Kenneth Thompson
*Assistant Examiner* — Sonya Bible

(57) ABSTRACT

An assembly for producing oil and/or gas through a well traversing stacked oil and/or gas bearing earth layers comprises a series of expandable packers and integrated perforating gun and sandscreen assemblies mounted on a production tubing such that each integrated perforating gun and sandscreen assembly is located adjacent an oil and/or gas bearing earth layer and at least one expandable packer is located between a pair of adjacent oil and/or gas bearing earth layers, and at least one inflow opening arranged in the wall of the production tubing adjacent to each sandscreen assembly. The integrated perforating gun and sandscreen assemblies are installed in a single run into the well such that uncontrolled fluid and/or sand influx into the well before installation of the sandscreens and expandable packers is avoided.

10 Claims, 2 Drawing Sheets

Fig.2.
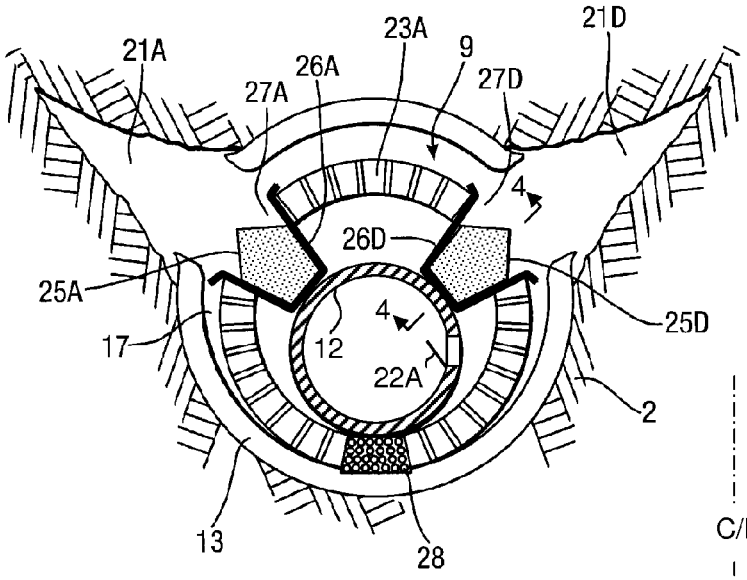
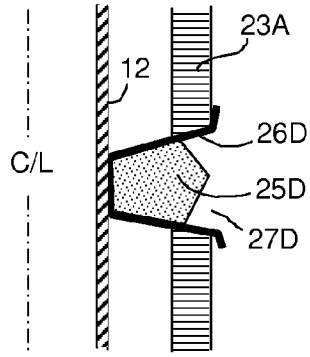
Fig. 4
Fig.3.
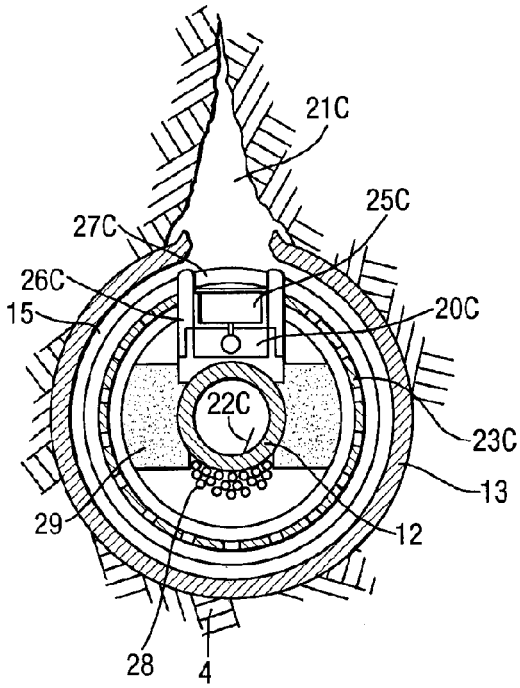
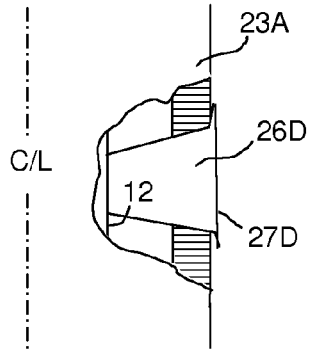
Fig. 5

METHOD AND ASSEMBLY FOR PRODUCING OIL AND/OR GAS THROUGH A WELL TRAVERSING STACKED OIL AND/OR GAS BEARING EARTH LAYERS

PRIORITY CLAIM

The present application claims priority from PCT Application PCT/EP2007/060195, filed 26 Sep. 2007, which in turn claims priority from European Patent Application 06121527.3 filed 29 Sep. 2006.

BACKGROUND OF THE INVENTION

The invention relates to a method and assembly for producing oil and/or gas through a well traversing stacked oil and/or gas bearing earth formations that are separated by one or more sealing earth layers having a low permeability.

If oil and/or gas is to be produced via a single well that traverses a plurality of stacked oil and/or gas bearing earth formations, that are generally called stacked reservoirs, then the shooting of perforations into these reservoirs and the subsequent installation of sandscreens and production equipment within the well may be a time consuming operation. The fluid pressure of the fluids in the pore spaces of the stacked reservoirs may be different, which may induce fluid to flow via the well from one reservoir to another, which may lead to an uncontrollable flux of fluids from a high pressure to a low pressure reservoir and sand erosion and/or deposition within the still uncompleted wellbore.

Typically perforations are shot into the oil and/or gas bearing formation, the well casing and/or well liner surrounding the wellbore by a perforating gun assembly as known from U.S. Pat. No. 6,404,139 before installation of the sandscreen and well packers in order to prevent damage to these fragile pieces of equipment.

It is known from US patent application US2003/0230406 to arrange perforation guns on a strip arranged in the annulus between a sandscreen and a production tubing such that the guns shoot perforations in a tangential direction into the tubing. This known perforation method involves a significant risk of damage to the sandscreen and only shoots perforations of a limited depth into the formation surrounding the tubing.

It is an object of the present invention to provide a method and assembly for producing oil and/or gas through a well traversing stacked oil and/or gas bearing formations, wherein perforations can be shot in a quick and efficient manner into the surrounding formation, well casing and/or liner and such that after shooting of the perforations flux of fluids between the various oil and/or gas bearing formations can be inhibited.

SUMMARY OF THE INVENTION

In accordance with the invention there is provided a method of producing oil and/or gas through a well traversing stacked oil and/or gas bearing earth layers, the method comprising:

assessing locations along the length of the well where the well path traverses said stacked oil and/or gas bearing earth layers;

mounting a plurality of expandable packers and integrated perforating gun and sandscreen assemblies on a production tubing such that when the production tubing is installed within the well each integrated perforating gun and sandscreen assembly is located adjacent an oil and/or gas bearing earth layer and at least one expandable packer is located between each pair of adjacent oil and/or gas bearing earth layers;

providing the production tubing with at least one inflow opening adjacent to each sandscreen assembly;

installing the production tubing within the well such that each integrated perforating gun and sandscreen assembly is located adjacent an oil and/or gas bearing earth layer and at least one expandable packer is located between each pair of adjacent oil and/or gas bearing earth layers;

inducing each expandable packer to expand and provide an annular seal between the outer surface of the tubing and the inner surface of wellbore or wellbore casing;

firing the perforation gun assemblies such that each perforating gun assembly shoots a perforation into the wellbore casing and/or surrounding oil and/or gas bearing layer; and producing oil and/or gas by inducing oil and/or gas to flow from each oil and/or gas bearing layer via the perforations through the sandscreen assemblies and inflow openings into the interior of the production tubing, and wherein at least one sandscreen assembly is substantially tubular and is penetrated by at least one perforating gun comprising an explosive charge that is arranged within a cup shaped gun shroud with a bottom that is secured to the production tubing, a tubular side wall that extends through an opening in the tubular sandscreen assembly and a firing mouth that is arranged in an annular space between the outer surface of the tubular sandscreen and an inner wall of the well or of a well casing or well liner.

Preferably, at least one expandable packer is a swellable packer that comprises a material that gradually swells within the wellbore, such as a water swellable material that swells up within several days after insertion of the packer within the well.

If the fluid pressures within the pores of the stacked oil and/or gas bearing layer are different from each other then it is preferred that at least one inflow opening in the production tubing is provided with an adjustable inflow control valve in order to avoid oil and/or gas to flow from one into another layer.

At least one sandscreen assembly may be penetrated by a plurality of perforating guns, which may penetrate the tubular sandscreen assembly at circumferentially and/or axially spaced locations.

The invention also provides an assembly for producing oil and/or gas through a well traversing stacked oil and/or gas bearing earth layers, comprising:

a plurality of expandable packers and integrated perforating gun and sandscreen assemblies mounted on a production tubing, such that when the production tubing is installed within the well each integrated perforating gun and sandscreen assembly is located adjacent an oil and/or gas bearing earth layer and at least one expandable packer is located between a pair of adjacent oil and/or gas bearing earth layers; and at least one inflow opening arranged in the wall of the production tubing adjacent to each sandscreen assembly;

wherein at least one sandscreen assembly is substantially tubular and is arranged around the production tubing and is penetrated by at least one perforating gun comprising an explosive charge that is arranged within a cup shaped gun shroud with a bottom that is secured to the production tubing, a tubular side wall that extends through an opening in the tubular sandscreen assembly and a firing mouth that is arranged in an annular space between the outer surface of the tubular sandscreen and an inner wall of the well or of a well casing or well liner.

These and other features, embodiments and advantages of the method and assembly according to the invention are described in the accompanying claims, abstract and the following detailed description of preferred embodiments in which reference is made to the accompanying drawings.

BRIEF DESCRIPTION OF THE DRAWINGS

FIG. 2 is a schematic split cross-sectional view of the uppermost integrated perforation gun and sandscreen assembly of FIG. 1, which comprises two perforating gun assemblies that penetrate the sandscreen at circumferentially spaced locations; and FIG. 3 is a schematic cross-sectional view of the lowermost integrated perforation gun and sandscreen assembly of FIG. 1, which comprises a single perforating gun assembly that penetrates the sandscreen.

FIG. 4 is a schematic cross-section taken along lines 4-4 of FIG. 2; and FIG. 5 is a schematic cut-away view of the components shown in FIG. 4.

DETAILED DESCRIPTION OF PREFERRED EMBODIMENTS

Figure 1:
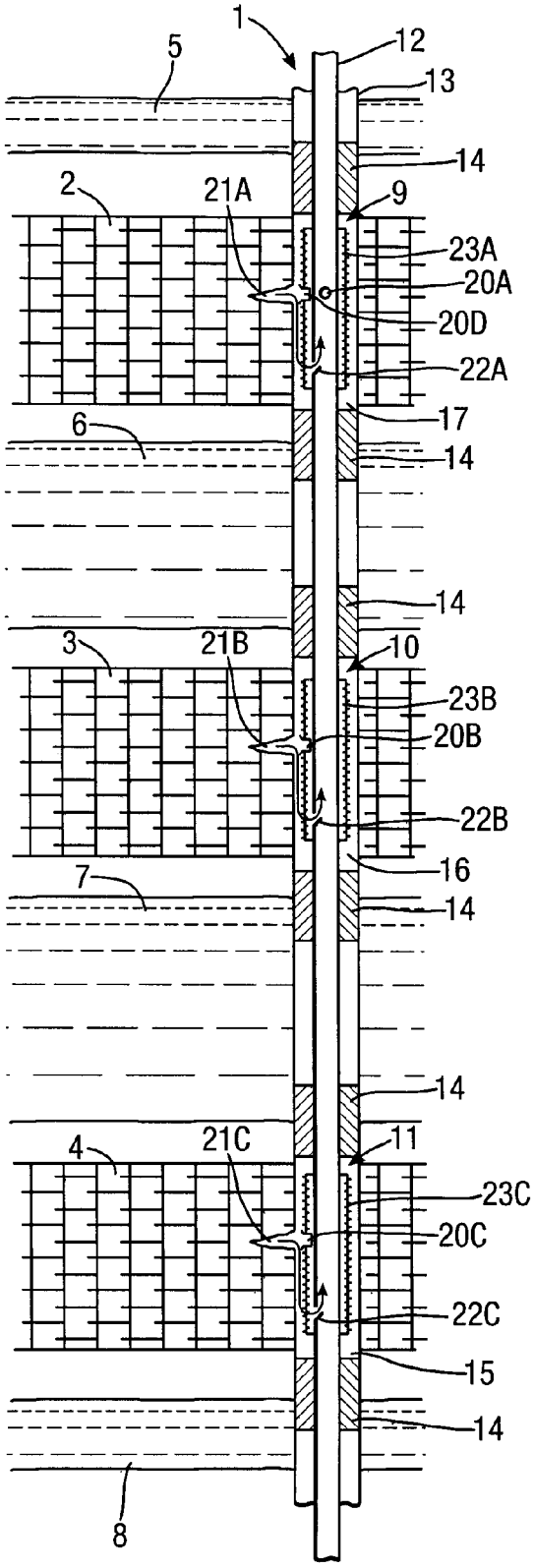
FIG. 1 is a schematic longitudinal sectional view of a well with three integrated perforation and sandscreen assemblies according to the invention, which are each arranged adjacent to one of three stacked oil and/or gas bearing earth layers traversed by the well.

FIG. 1 depicts a well 1 which traverses three stacked oil and/or gas bearing formations 2,3 and 4, which are separated from each other and from other formation layers by sealing layers 5,6,7 and 8.

The well 1 is equipped with a three integrated perforation gun and sandscreen assemblies 9,10 and 11 according to the invention. The assemblies 9,10 and 11 are mounted on a production tubing 12, which is suspended within a well casing 13. A series of six swellable packers 14 is mounted on the outer surface of the production tubing 12 such that the swellable packers 14 are located in the vicinity of the sealing layers 5-8, thereby creating three annular spaces 15,16 and 17 which each contain one of the integrated perforation gun and sandscreen assemblies 9,10 and 11 and which are sealed from each other and from other annular areas between the well casing 13 and production tubing 12.

After descend of the production tubing 12 into the well 1 it is suspended at a fixed level during a couple of days to permit the packers 14 to swell up by absorbing water from the wellbore. Once the packers 14 provide fluid tight seals in the annular space between the production tubing 12 and well casing 13 the perforating guns 20A-D are fired such that the well casing 13 is perforated and the surrounding formation is fractured such that fractured cavities 21A-D are created in the oil and/or gas bearing formations 2,3 and 4.

The production tubing is equipped with three inflow control valves 22A-C which are opened after firing of the perforation guns 20A-D such that oil and/or gas is permitted to flow from the oil and/or gas bearing formations 2,3 and 4 via the fractured cavities 21A-D into the annular spaces 15,16 and 17 and through the openings in the sandscreens 23A-C and the opened inflow control valves 22A-C into the production tubing 12.

The inflow control valves 22A-C are then adjusted to initiate a substantially equal influx of oil and/or gas from each of the oil and/or gas bearing formations 2,3 and 4.

FIG. 2 is a schematic cross-sectional view of the upper integrated perforation gun and sandscreen 30 assembly 9, FIG. 4 is a cross-section along lines 4-4 of FIG. 2, and FIG. 5 is a cut-away view showing the components of FIG. 4 in profile. Referring to FIGS. 2, 4, and 5, the assembly 9 comprises two circumferentially spaced perforating guns 20A and 20D which each comprise an explosive charge 25A, 25 D that is arranged within a cup shaped gun shroud 26A, 26D with a bottom that is secured to the production tubing 12, a tubular side wall that extends through an opening in the tubular sandscreen 23A and a firing mouth 27A, 27D that is arranged in the substantially annular space 17 between 5 the outer surface of the tubular sandscreen 23A and an inner wall of the well casing 13. A bundle of measuring and/or control lines 23 is arranged in a flat pack that is secured to the outer surface of the production tubing 12. The control lines 23 are connected to the 10 firing mechanisms of the explosive charges 25A-D, the inflow control valves 22A-C and to sensors (not shown) for monitoring temperature, pressure, seismic waves and/or other physical parameters in the inflow regions of the well 1.

FIG. 3 depicts the lowermost integrated perforation gun and sandscreen assembly 11 of FIG. 1. This assembly 11 comprises a single perforating gun 20C, which comprises a shaped explosive charge 25C that is arranged within a cup shaped gun shroud 26C with a bottom that is secured to the production tubing 12, a tubular side wall that extends through an opening in the tubular sandscreen 23C and a firing mouth 27C that is arranged in the substantially annular space 15 between the outer surface of the tubular sandscreen 23C and an inner wall of the well casing 13. The bundle of measuring and/or control lines 23 is secured to the outer surface of the production tubing 12 and spacer blades 29 are arranged between the production tubing 12 and tubular sandscreen 23C in order to maintain the production tubing 12 in a substantially concentric position within the tubular sandscreen 23C.

In order to illustrate the design of the shaped charges 25A,C and D they are illustrated in FIGS. 2 and 3 before detonation thereof, whereas FIGS. 2 and 3 also illustrate the shape of the fractured cavities 21A,C and D, which are created after detonation of the charges.

It will be understood that the method and integrated perforating gun assembly according to the invention facilitate installation of multiple sandscreen assemblies in stacked oil and/or gas bearing formations in a quick manner and such that the assemblies and perforation guns are installed in a single run, so that the installation time is reduced to a minimum. Furthermore arrangements of the expanded packers 14 between the various oil and/or gas bearing earth layers 2,3 and 4 before the perforations 21A-D are shot into the well casing 13 and surrounding earth layers 2,3 and 4 avoids that formation fluids flow into the well 1 and optionally via the well into earth layers with pores in which the fluid pressure is lower than in other formation layers, so that fluid flux and possible sand flux, erosion and deposition before installation of the sandscreens 23A-C is mitigated. It will be understood that the sandscreens will also stop influx into the production tubing 12 of other granular materials than sand, such as clay, silt and rock particles.

What is claimed is:

1. A method of producing oil and/or gas through a well traversing stacked oil and/or gas bearing earth layers, the method comprising:

assessing locations along the length of the well where the well path traverses said stacked oil and/or gas bearing earth layers;

mounting a plurality of expandable packers and integrated perforating gun and sandscreen assemblies on a production tubing such that when the production tubing is installed within the well each integrated perforating gun and sandscreen assembly is located adjacent an oil and/or gas bearing earth layer and at least one expandable packer is located between each pair of adjacent oil and/or gas bearing earth layers;

providing the production tubing with at least one inflow opening adjacent to each sandscreen assembly;

installing the production tubing within the well such that each integrated perforating gun and sandscreen assembly is located adjacent an oil and/or gas bearing earth layer and at least one expandable packer is located between each pair of adjacent oil and/or gas bearing earth layers;

inducing each expandable packer to expand and provide an annular seal between the outer surface of the tubing and the inner surface of the wellbore or wellbore casing;

firing the perforation gun assemblies such that each perforating gun assembly shoots a perforation into the wellbore casing and/or surrounding oil and/or gas bearing layer; and producing oil and/or gas by inducing oil and/or gas to flow from each oil and/or gas bearing layer via the perforations through the sandscreen assemblies and inflow openings into the interior of the production tubing, wherein at least one sandscreen assembly is substantially tubular and is penetrated by at least one perforating gun comprising an explosive charge that is arranged within a cup shaped gun shroud with a bottom that is secured to the production tubing, a tubular side wall that extends through an opening in the tubular sandscreen assembly and a firing mouth that is arranged in an annular space between the outer surface of the tubular sandscreen and an inner wall of the well or of a well casing or well liner.

2. The method of claim 1, wherein at least one expandable packer is a swellable packer that comprises a material that gradually swells within the wellbore.

3. The method of claim 2, wherein the material is a water swellable material that swells up within several days after insertion of the packer within the well.

4. The method of claim 1, wherein at least one inflow opening in the production tubing is provided with an adjustable inflow control valve.

5. The method of claim 1, wherein at least one sandscreen assembly is penetrated by a plurality of perforating guns.

6. The method of claim 5, wherein the perforating guns penetrate the tubular sandscreen assembly at circumferentially and/or axially spaced locations.

7. An assembly for producing oil and/or gas through a well traversing stacked oil and/or gas bearing earth layers, comprising:

a plurality of expandable packers and integrated perforating gun and sandscreen assemblies mounted on a production tubing such that when the production tubing is installed within the well each integrated perforating gun and sandscreen assembly is located adjacent an oil and/or gas bearing earth layer and at least one expandable packer is located between a pair of adjacent oil and/or gas bearing earth layers; and at least one inflow opening arranged in the wall of the production tubing adjacent to each sandscreen assembly;

wherein at least one sandscreen assembly is substantially tubular and is arranged around the production tubing and is penetrated by at least one perforating gun comprising an explosive charge that is arranged within a cup shaped gun shroud with a bottom that is secured to the production tubing, a tubular side wall that extends through an opening in the tubular sandscreen assembly and a firing mouth that is arranged in an annular space between the outer surface of the tubular sandscreen and an inner wall of the well or of a well casing or well liner.

8. The assembly of claim 7, wherein the packers are water swellable packers and at least one inflow opening is equipped with an adjustable inflow control valve.

9. The assembly of claim 7, wherein at least one sandscreen assembly is arranged around the production tubing.

10. The assembly of claim 7, wherein at least one firing mouth is oriented in a substantially radial orientation relative to a central axis of the wellbore.

* * * * *